US006218773B1

(12) United States Patent
Misono et al.

(10) Patent No.: US 6,218,773 B1
(45) Date of Patent: Apr. 17, 2001

(54) DEFLECTION YOKE FOR COLOR CATHODE RAY TUBE

(75) Inventors: Takehiro Misono, Fukushima; Takahiro Suzuki; Shigemi Oguchi, both of Kanagawa, all of (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/357,943

(22) Filed: Jul. 21, 1999

(30) Foreign Application Priority Data

Jul. 31, 1998 (JP) ..... 10-216716

(51) Int. Cl.[7] ..... H01J 29/76
(52) U.S. Cl. ..... 313/440; 335/213; 335/210
(58) Field of Search ..... 313/440, 428, 313/432, 431; 335/210, 211, 212, 213, 296

(56) References Cited

U.S. PATENT DOCUMENTS 5,250,876 * 10/1993 Van Mierlo et al. ..... 313/440
5,598,055 * 1/1997 Inoue et al. ..... 335/213 X
5,945,779 * 8/1999 Inoue et al. ..... 313/440

* cited by examiner

*Primary Examiner*—Ashok Patel
(74) *Attorney, Agent, or Firm*—Ronald P. Kananen; Rader, Fishman & Grauer

(57) ABSTRACT

A deflection yoke which can simultaneously achieve suppression of induction current arising from an influence of a raster rotation correction coil and correction of misconvergence which varies the current balance of horizontal deflection coils. The deflection yoke of the present invention includes a raster rotation coil, and a pair of coils sharing a single core and respectively connected in series to an upper side horizontal deflection coil and a lower side horizontal deflection coil. The pair of coils are connected such that the polarities thereof may be opposite to each other. The pair of coils suppress current induced by a magnetic field of the raster rotation coil. In order to apply a bias to the pair of coils which share the core, a single bias coil is wound on the shared core on which the pair of coils are wound. Part of horizontal deflection current is supplied to the bias coil thereby to produce a difference in current flowing through the upper side horizontal deflection coil and the lower side horizontal deflection coil. Correction of misconvergence is allowed thereby.

5 Claims, 11 Drawing Sheets

DEFLECTION YOKE FOR COLOR CATHODE RAY TUBE

BACKGROUND OF THE INVENTION

This invention relates to a deflection yoke which includes a raster rotation coil, and more particularly to a deflection yoke which allows compatibility of correction of raster distortion other than raster rotation performed using a raster rotation coil and correction of misconvergence performed by producing a difference in current between an upper side horizontal deflection coil and a lower side horizontal deflection coil.

Some deflection yokes for a color cathode ray tube include a raster rotation coil. A raster rotation coil is frequently located on the front side of a deflection yoke, that is, adjacent to a screen with respect to a cathode ray tube.

FIG. 1 is a perspective view showing an entire deflection yoke which includes a raster rotation coil, and FIG. 2 is a side elevational view showing only coils and a DY core of the deflection yoke of FIG. 1.

A pair of upper and lower saddle type horizontal deflection coils 3 are wound around a horizontal deflection coil bobbin 1. A pair of left and right saddle type vertical deflection coils 7 are wound around a vertical deflection coil bobbin 5 on the outer sides of the horizontal deflection coils 3.

A DY core 9 made of ferrite is mounted such that it surrounds the vertical deflection coils 7. An annular (circular, polygonal or the like) raster rotation coil 11 is mounted along an outer periphery of the deflection yoke on the front side of the deflection yoke. It is to be noted that, in FIGS. 1 and 2, reference numeral 13 denotes an adjustment knob, 15 an adjustment coil, 17 a rear cover, and 19 a front cover.

The raster rotation coil 11 has a winding of several hundreds turns of a nylon-coated wire of a diameter of approximately ø 0.2 to ø 0.4 mm.

The raster rotation coil 11 is usually used in order to correct rotation of a raster appearing on the screen of the cathode ray tube around an axis of the tube.

For example, if a location of a receiver in which a cathode ray tube is used is varied, then the influence of the terrestrial magnetism upon the cathode ray tube varies. This sometimes rotates the raster in a fixed direction into an inclined state.

In such an instance, the raster in an inclined state is corrected by DC current flowing in the raster rotation coil.

In addition, a magnetic field generated by the raster rotation coil interferes with the deflection coil. However, if fixed DC current flows in the raster rotation coil, then also the magnetic field is fixed and it does not occur that induction current flows in the deflection coil as a result of the interference. Consequently, a convergence characteristic is not influenced by the interference.

If a triangular wave current having a period equal to a vertical deflection period or an arbitrary period or an alternating current of an arbitrary waveform is supplied to the raster rotation coil 11, then also the amount of rotation of the raster varies in response to the amount of the current. This allows correction of a distortion other than raster rotation, for example, correction of trapezoid distortion or the like of a raster. This technique is effective to products for which a severe quality in regard to raster distortion is required, for example, to display units for computers.

However, since the magnetic field generated by the raster rotation coil varies with respect to time, induction current flows in the deflection coil by an influence of the temporal variation of the magnetic field. This current causes a variation of the convergence characteristic and gives rise to so-called misconvergence.

A countermeasure against this problem has been proposed already. Referring to FIG. 3, a pair of coils 21 wound on a shared core are respectively connected in series to two upper and lower horizontal deflection coils 23 and 25. The pair of coils have a strong magnetic connection since they share the core.

In the deflection yoke 27 having such a construction as described above, the coils 21 connected in series to the two upper and lower horizontal deflection coils 23 and 25 have high inductance values only for induction current generated by a variation of the magnetic field of the raster rotation coil.

For example, if triangular wave current flows through the raster rotation coil 11, then induction current flows in the deflection coils. The induction current is suppressed by the coils 21 connected in series to the upper side horizontal deflection coil 23 and the lower side horizontal deflection coil 25.

Consequently, little influence is on the deflection current flowing in the circuitry of the receiver, and only the induction current induced by a variation of the magnetic field of the raster rotation coil is suppressed and the variation of convergence can be reduced. Since the coils 21 have a function of suppressing induction current, they are called induction current suppressing coils.

However, a series connection of such two coils having a strong magnetic connection as described above to upper and lower horizontal deflection coils gives rise to a new problem. In particular, if a vertical assembly error remains between a cathode ray tube and a deflection yoke, then this causes vertical asymmetry between an electron beam of the cathode ray tube and a horizontal deflection magnetic field. For example, if the horizontal deflection magnetic field is displaced downwardly with respect to the electron beam as shown in FIG. 4A, then misconvergence as shown in FIG. 4B appears on the screen.

As a popular method of correcting the misconvergence, variable coils are connected in series to upper and lower side deflection coils as shown in FIG. 4C. The variable coils are used in order to adjust the balance in inductance value, and therefore called balance coils.

If the inductance value of a balance coil increases, then the current flowing therethrough decreases, but if the inductance value decreases, then the current increases. By adjustment of the balance coils, a difference can be provided between the amounts of deflection current to be supplied to the upper and lower side horizontal deflection coils.

Vertical asymmetry of the magnetic field can be adjusted by the difference in current. Accordingly, vertical asymmetry of the deflection current can be corrected as shown in FIG. 4D, and the misconvergence illustrated in FIG. 4B can be corrected.

However, in the circuit shown in FIG. 3, the induction current suppressing coils 21 connected in series between the upper and lower side horizontal deflection coils and the upper and lower side balance coils have a strong magnetic connection and are connected in the opposite phases to each other.

Therefore, even if it is tried to adjust the current between the upper and lower side horizontal deflection coils, the induction current suppressing coils 21 act to cancel current variations of the upper and lower side horizontal deflection coils.

Accordingly, for a deflection yoke for which a coil for suppressing induction current is mounted, the method of correcting misconvergence using balance coils which are used popularly cannot be used.

SUMMARY OF THE INVENTION

It is an object of the present invention to provide a deflection yoke which can simultaneously achieve correction of raster distortion by supplying current of an arbitrary period to a raster rotation coil and correction of misconvergence by producing a difference in current between upper and lower side horizontal deflection coils.

A deflection yoke according to the present invention includes a pair of saddle type horizontal deflection coils and a pair of saddle type or troidal type vertical deflection coils and further includes an annular raster rotation coil centered at an axis of a cathode ray tube and provided on the front side of the deflection yoke.

A pair of coils are respectively connected in series to the upper side horizontal deflection coil and the lower side horizontal deflection coil. The pair of coils are wound on a shared core and connected to the horizontal deflection coils such that the polarities of the coils may be opposite to each other. Consequently, the pair of coils have a strong magnetic connection. Preferably, the coupling coefficient of the pair of coils is as high as possible.

Further, a single bias coil is wound on the core on which the pair of coils are wound. Part of the horizontal deflection current flows through the bias coil.

The deflection yoke of the present invention is characterized in that a difference in current flowing through the upper side horizontal deflection coil and the lower side horizontal deflection coil is produced with the current which flows through the bias coil.

With the deflection yoke, if part of the horizontal deflection current flows into the bias coil, then this tends to generate magnetic fluxes inside the core of the pair of coils. At this time, induction current flows in the pair of coils having a strong magnetic connection so that the magnetic fluxes inside the core of the pair of coils may be cancelled. The induction current varies the balance between the deflection current flowing through the upper side horizontal deflection coil and the current flowing through the lower side horizontal deflecting coil. Consequently, a difference is produced between the current which flows through the upper side horizontal deflection coil and the current which flows through the lower side horizontal deflection coil.

Accordingly, by adjusting the current to be supplied to the bias coil, misconvergence arising from vertical asymmetry of the horizontal deflection magnetic fields can be corrected.

In order to adjust the current to be supplied to the bias coil, a bridge circuit which includes four inductors can be used. An input terminal of bridge circuit is connected to the low voltage sides of the horizontal deflection coils. Accordingly, as input current, horizontal deflection current flows. A pair of output terminals of the bridge circuit are connected to the bias coil. The balance of the bridge circuit depends upon the values of the four inductors, and the amount and the direction of current flowing through the bias coil depend upon the balance.

If the four inductors are variable inductors, the inductance values of them can be adjusted freely. The amount and the direction of current to flow through the bias coil can be adjusted by adjustment of the variable inductors. Accordingly, the correction amount and the polarity of misconvergence can be adjusted.

It is also possible to use a non-linear inductor for the bridge circuit. For example, if a fixed bias magnetic field with a permanent magnet is applied to a coil, the inductance value of the coil indicates non-linearity. An inductor of the type just described is called a saturable reactor.

Where a non-linear inductor is used, operation of the bridge circuit varies depending upon the direction and the magnitude of the horizontal deflection current.

Alternatively, an inductor whose bias magnetic field varies in response to the vertical deflection current may be used for the bridge circuit. In this instance, of the bridge circuit varies also in response to the direction and the magnitude of the vertical deflection current.

Where a non-linear inductor is used in this manner, a correction pattern of misconvergence can be operated within a fixed range.

The current to be supplied to the bias coil need not always be part of the deflection current. For example, a circuit for driving the bias coil may be provided in a receiver such that current is supplied from the circuit to the bias coil.

In the deflection yoke just described, current of an arbitrary waveform can be supplied to the bias coil. Accordingly, the balance in current between the upper side horizontal deflection coil and the lower side horizontal deflection coil can be varied arbitrarily.

The above and other objects, features and advantages of the present invention will become apparent from the following description and the appended claims, taken in conjunction with the accompanying drawings in which like parts or elements are denoted by like reference symbols.

DETAILED DESCRIPTION OF THE PREFERRED EMBODIMENTS

Figure 1:
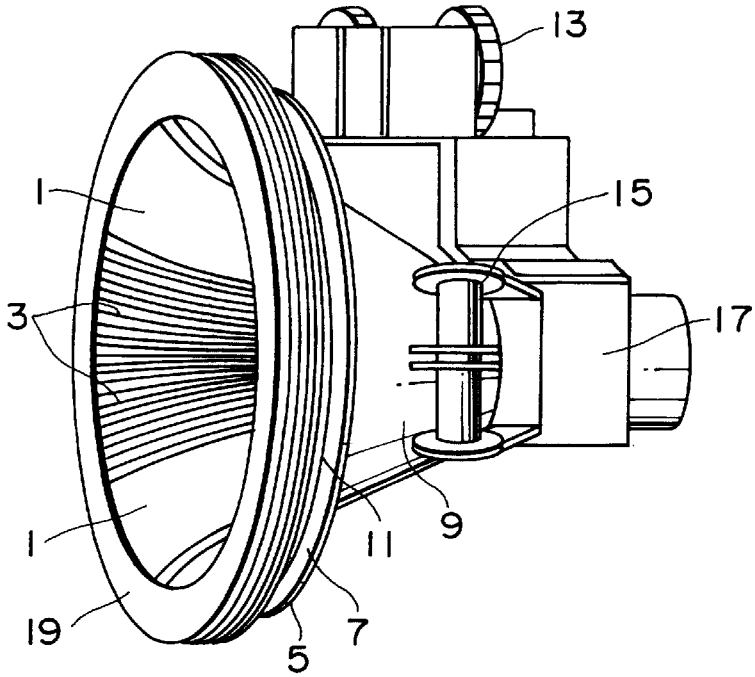
FIG. 1 is a perspective view showing a conventional deflection yoke.
Figure 2:
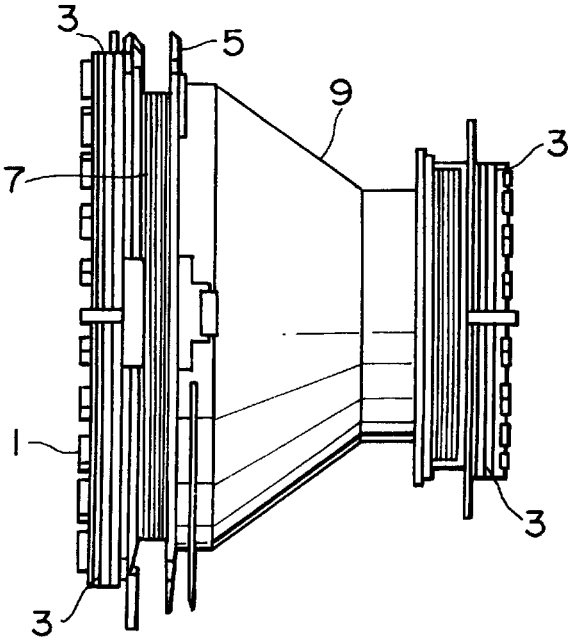
FIG. 2 is a side elevational view showing coils and a core of the deflection yoke of FIG. 1.
Figure 3:
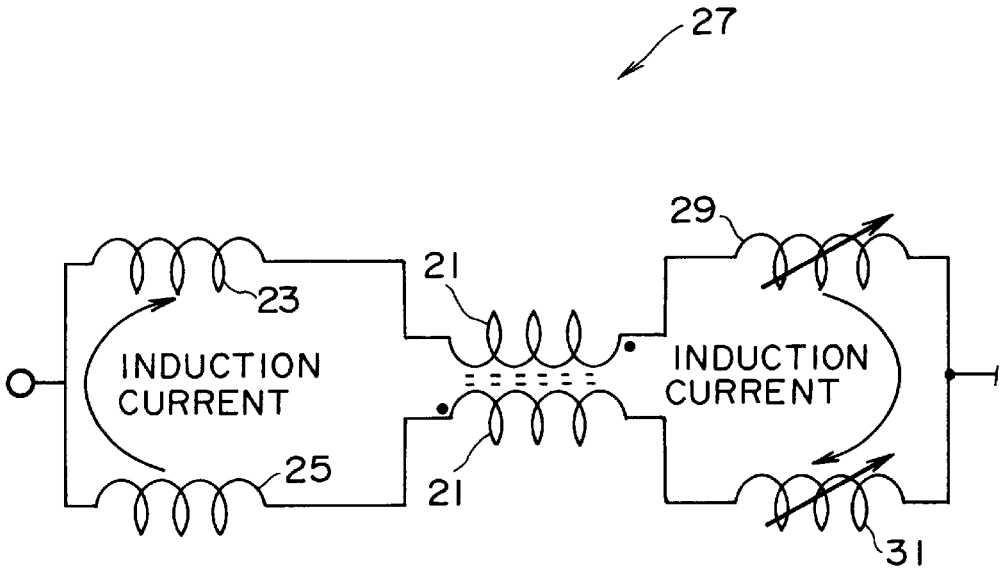
FIG. 3 is a connection diagram of a conventional deflection yoke.
Figure 4A:
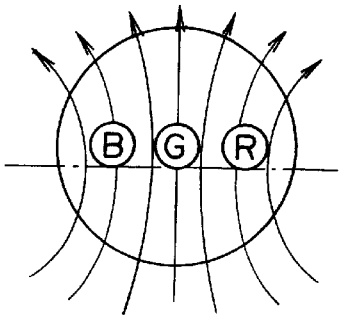
FIG. 4A is a diagrammatic view illustrating a manner wherein horizontal deflection magnetic fields generated from horizontal deflection coils are displaced downwardly with respect to an electron beam.
Figure 4B:
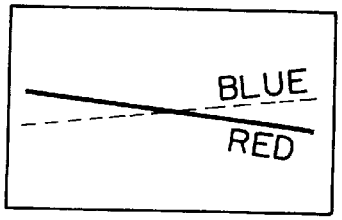
FIG. 4B is a diagrammatic view illustrating misconvergence generated when horizontal deflection magnetic fields are displaced downwardly.
Figure 4C:
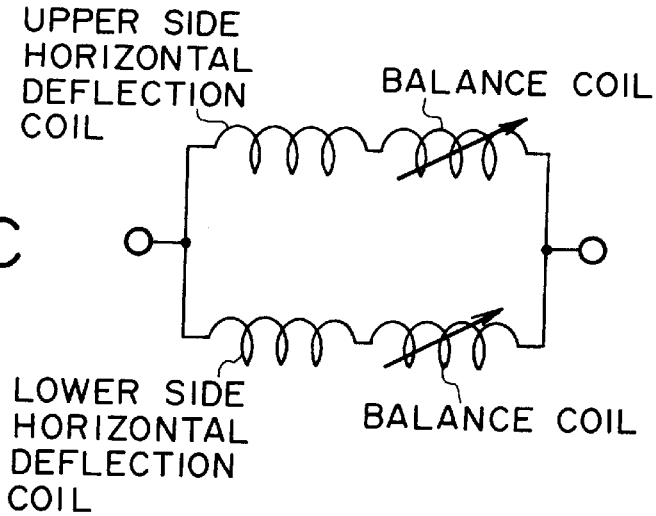
FIG. 4C is a connection diagram showing a connection of upper and lower side horizontal deflection coils and balance coils.
Figure 4D:
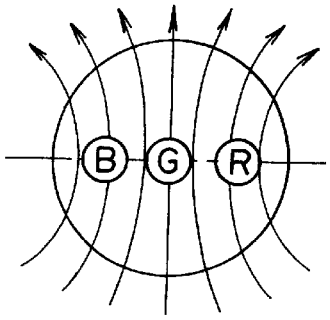
FIG. 4D is a diagrammatic view illustrating a manner wherein displacement of horizontal deflection magnetic fields are modified by an action of the balance coils.

Referring first to FIGS. 5 to 7A and 7B, there is shown a first embodiment of a deflection yoke according to the present invention. The deflection yoke 41 according to the present embodiment includes an induction current suppression coil 43 shown in FIG. 6 for suppressing induction current generated inside horizontal deflection coils. The induction current suppression coil 43 includes two stranded wires 47 and 49 wound commonly on a ring-shaped core 45 (for example, a ferrite core) of a diameter of approximately 10 to 30 mm. Each of the stranded wires 47 and 49 is composed of seven wires of a diameter of approximately 0.15 mm. The number of turns of each of the stranded wires 47 and 49 is approximately 5 to 20 turns. The specifications of the wire materials, numbers of turns and so forth of the core 45 and stranded wires 47 and 49 depend upon conditions in which the deflection yoke is used.

Figure 7A:
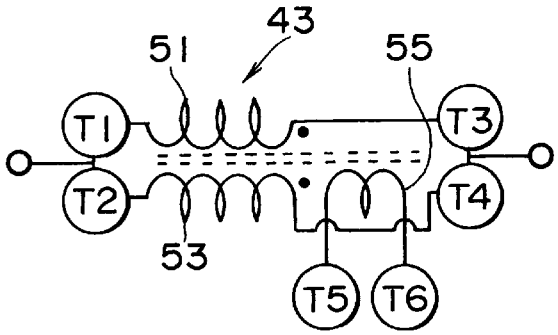
FIG. 7A is a connection diagram showing an example of a high impedance connection of induction current suppression coils employed in the deflection yoke of FIG. 4.

In the induction current suppression coil 43, if terminals T1, T2, T3 and T4 of a pair of coils 51 and 53 are connected in such a manner as shown in FIG. 7A, then magnetic fluxes inside the core 45 are generated in the same direction from the pair of coils 51 and 53.

Accordingly, the inductance values of the pair of coils 51 and 53 are such high values as approximately 0.5 to 3 mH.

Figure 7B:
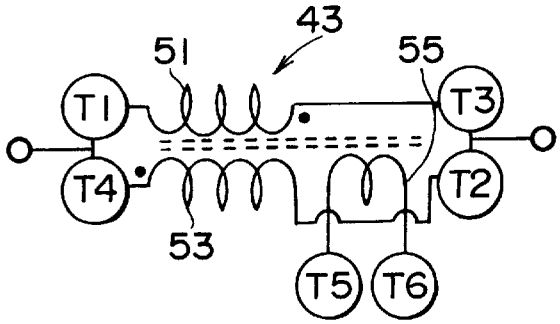
FIG. 7B is a connection diagram showing an example of a low impedance connection of the induction current suppression coils employed in the deflection yoke of FIG. 4.

If the terminals T1 and T4 and the terminals T3 and T2 on the opposite sides of the pair of coils 51 and 53 are connected to each other as shown in FIG. 7B, then magnetic fluxes generated inside the core 45 are directed opposite to each other. Accordingly, the inductance values of the pair of coils 51 and 53 are such low values as approximately 1 $\mu$H or less.

A bias coil 55 of approximately 2 to 6 turns is wound around the core 45 of the induction current suppression coil 43. The opposite ends of the bias coil 55 are connected to terminals T5 and T6.

Figure 5:
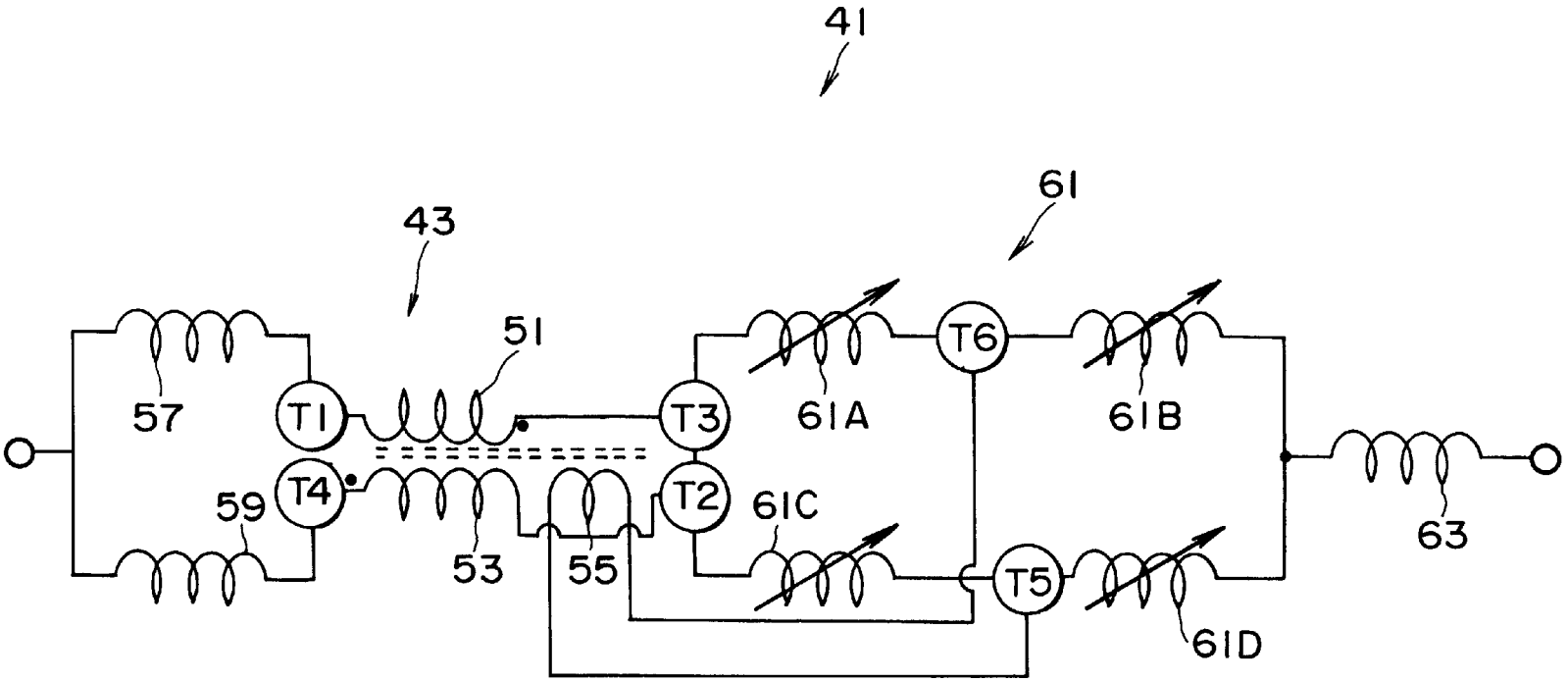
FIG. 5 is a connection diagram showing a first embodiment of a deflection yoke according to the present invention.
Figure 6:
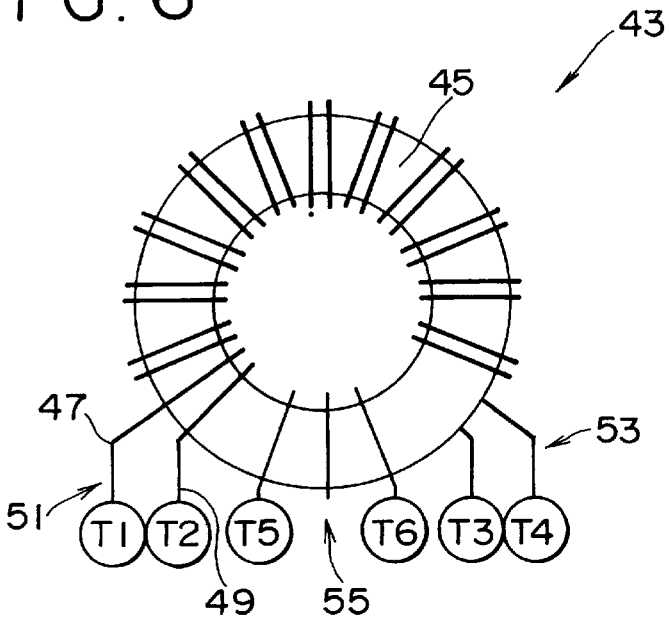
FIG. 6 is a schematic view showing an appearance of an induction current suppression coil used in the deflection yoke of FIG. 4.

In the deflection yoke 41, the induction current suppression coil 43 is connected to horizontal deflection coils with such a connection as shown in FIG. 5. The deflection yoke 41 includes a pair of saddle type horizontal deflection coils (upper side horizontal deflection coil 57 and lower side horizontal deflection coil 59) shown in FIG. 5. Further, an annular (circular, polygonal or the like) raster rotation coil not shown is mounted on the front side of the deflection yoke in such a manner as to be centered at an axis of a cathode ray tube.

The upper side horizontal deflection coil 57 and the lower side horizontal deflection coil 59 are connected at one ends thereof to each other. The other end of the upper side horizontal deflection coil 57 is connected to the terminal T1 of the coil 51. The other end of the lower side horizontal deflection coil 59 is connected to the terminal T4 of the coil 53. The coils 51 and 53 have inductance values of approximately 4 to 20 times the inductance values of the horizontal deflection coils, and the polarities thereof are opposite in phase to each other. The terminal T3 of the coil 51 and the terminal T2 of the coil 53 are connected to a bridge circuit 61.

The bridge circuit 61 includes a parallel connection of a pair of variable inductors 61A and 61B connected in series and another pair of variable inductors 61C and 61D connected in series similarly. The bridge circuit 61 has a pair of input terminals and a pair of output terminals. One of the input terminals, that is, the junction of the variable inductors 61A and 61C, is connected to the terminals T3 and T2 of the coils 51 and 53 while the other input terminal, that is, the junction between the variable inductors 61B and 61D, is connected to a leakage magnetic field cancellation coil 63. The cancellation coil 63 is used to cancel a magnetic field leaking to the outside of the receiver. Meanwhile, one of the output terminals, that is, the junction between the variable inductors 61A and 61B, is connected to the terminal T6 of the bias coil 55 while the other output terminal, that is, the junction between the variable inductors 61C and 61D, is connected to the terminal T5 of the bias coil 55.

Accordingly, since the bridge circuit 61 is formed from the variable inductors 61A, 61B, 61C and 61D, current flows in any direction through the bias coil 55.

Now, the operation of the deflection yoke 41 having the construction described above is described.

When the inductance values of the bridge circuit 61 are in a balanced condition so that no current may flow through the bias coil 55, current flows through the coils 51 and 53 so that the balance of the magnetic fields in the core 45 may be maintained. Usually, since the coils 51 and 53 are wound in an equal number of turns, also the current flowing through the coils 51 and 53 is equal.

When horizontal deflection current flows through the coils 51 and 53, the magnetic fields generated from the coils 51 and 53 cancel each other. Accordingly, the induction current suppression coil 43 acts as a resistor which has little inductance. The resistance value of the induction current suppression coil 43 is sufficiently low because the number of turns of the coil is small. Accordingly, the resistance value can be ignored practically. On the other hand, induction current induced by an influence of the raster rotation coil flows in such a manner as to circulate in a closed loop which includes the horizontal deflection coils 57 and 59. Accordingly, the magnetic fields generated from the coils 51 and 53 overlap each other, and the induction current suppression coil 43 has a high inductance value. Accordingly, the coil 43 suppresses flow of the induction current. In other words, the induction current suppression coil 43 suppresses only induction current generated by an influence of the raster rotation coil without having an influence on the deflection current at all.

Here, if the variable inductors 61A, 61B, 61C and 61D of the bridge circuit 61 are varied, then the balance of the bridge circuit 61 varies, and part of the horizontal deflection current flows into the bias coil 55. Consequently, the bias coil 55 tends to generate magnetic fluxes inside the core 45 of the induction current suppression coil 43. At this time, in the induction current suppression coil 43, induction current flows in a direction in which it prevents generation of magnetic fluxes inside the core 45. In other words, induction current is generated in the coils 51 and 53.

The induction current flows circulating the closed circuit including the deflection coils 57 and 59. Consequently, the induction current flows in the same direction as that of the deflection current in either one of the upper side horizontal deflection coil 57 and the lower side horizontal deflection coil 59, but flows in the opposite direction to that of the deflection current in the other side of them.

Consequently, the induction current varies the balance of the current flowing through the deflection coils 57 and 59.

Consequently, the balance of the magnetic fields generated from the upper side horizontal deflection coil 57 and the lower side horizontal deflection coil 59 varies. As a result, to suppress the induction current generated by an influence of the raster rotation coil and to vary the balance of the deflection current to correct misconvergence can be achieved simultaneously.

Next, a first modification and a second modification to the deflection yoke described above will be described.

Figure 8:
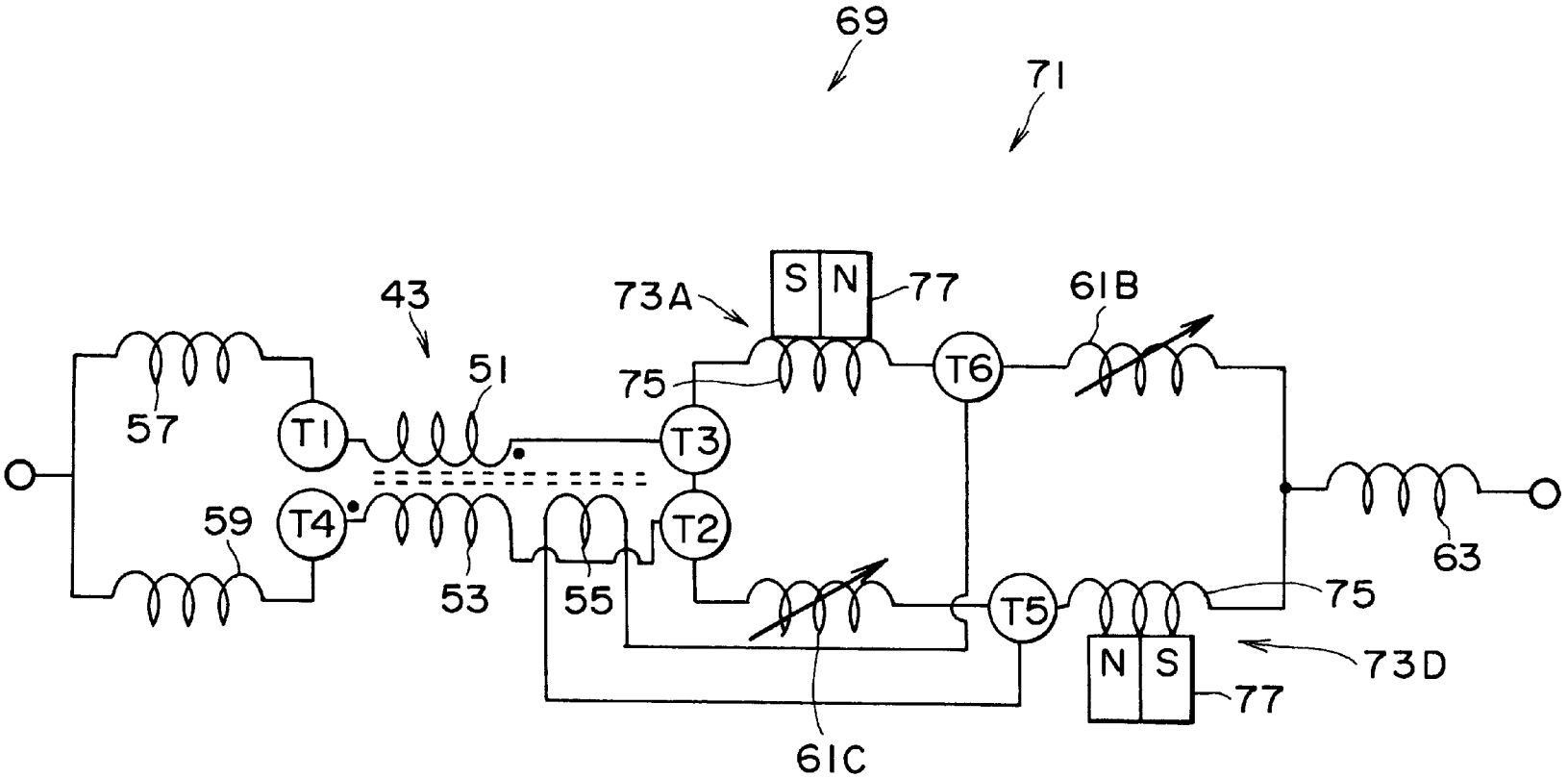
FIG. 8 is a connection diagram showing a first modification to the first embodiment of the deflection yoke according to the present invention.
Figures 9A, 9B:
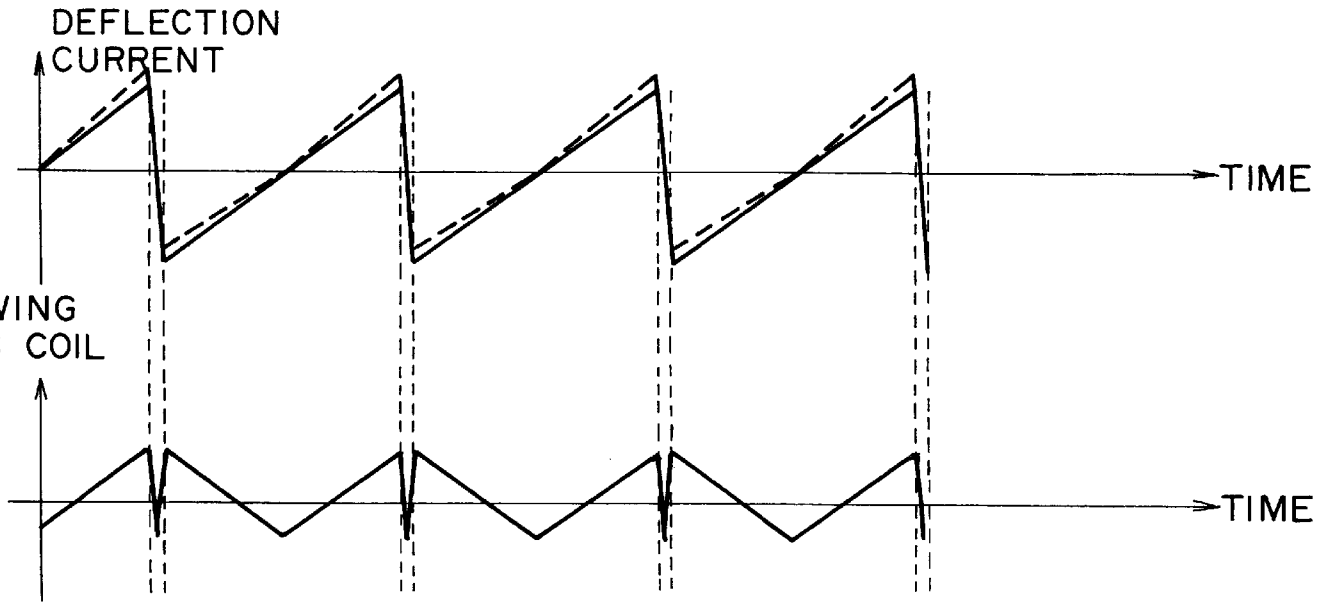
FIG. 9A is a waveform diagram showing deflection current flowing in the circuit of the first modification in the form of a current variation amount with respect to time.
FIG. 9B is a waveform diagram showing current flowing in a bias coil of the circuit of the first modification in the form of a current variation amount with respect to time.
Figure 10:
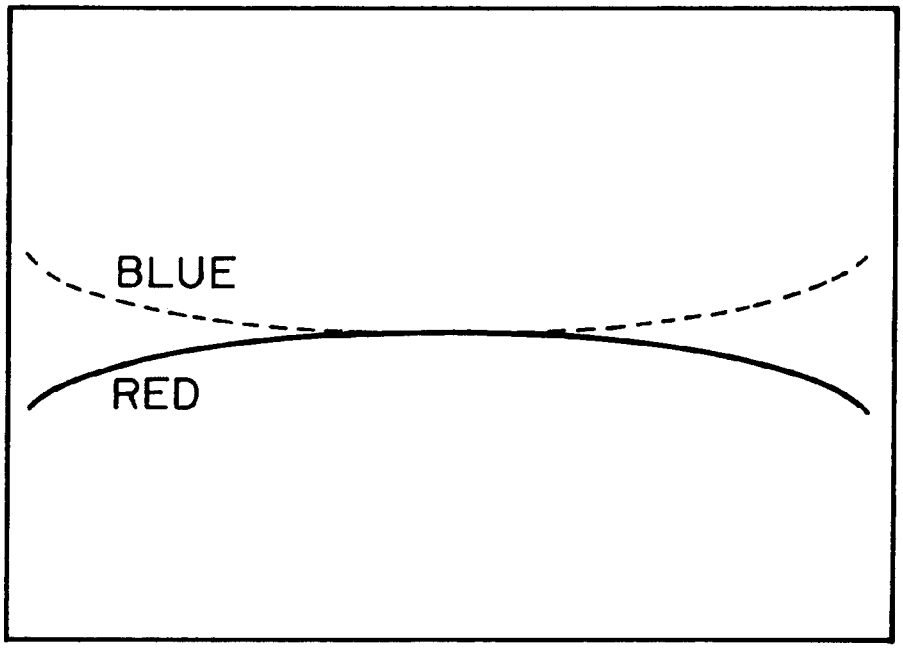
FIG. 10 a diagrammatic view showing an XV misconvergence pattern which appears on a screen of a cathode ray tube.

Referring first to FIGS. 8 to 10, a deflection yoke 69 according to the first modification uses a bridge circuit 71 in place of the bridge circuit 61 described above. The bridge circuit 71 includes saturable reactors 73*a* and 73*d* in place of the variable inductors 61A and 61D (refer to FIG. 5) which are components of the bridge circuit 61. Each of the saturable reactors 73*a* and 73*d* is composed of an inductor 75 and a permanent magnet 77.

If the magnitude and the direction of current flowing through the inductor 75 vary, the inductance value of the saturable reactor varies non-linearly.

The construction of the remaining part of the deflection yoke 69 is similar to that of the deflection yoke 41 described above.

With the present deflection yoke 69, the balance of the bridge circuit 71 varies in response to the magnitude and the direction of the horizontal deflection current by means of the saturable reactors 73A and 73D. Consequently, parabolic current can be generated in the bridge circuit 71. When current of a waveform shown in FIG. 9B is supplied to the bias coil 55, the horizontal deflection current becomes that having a waveform shown in FIG. 9A. Consequently, correction of misconvergence called XV illustrated in FIG. 10 is allowed.

Figure 11:
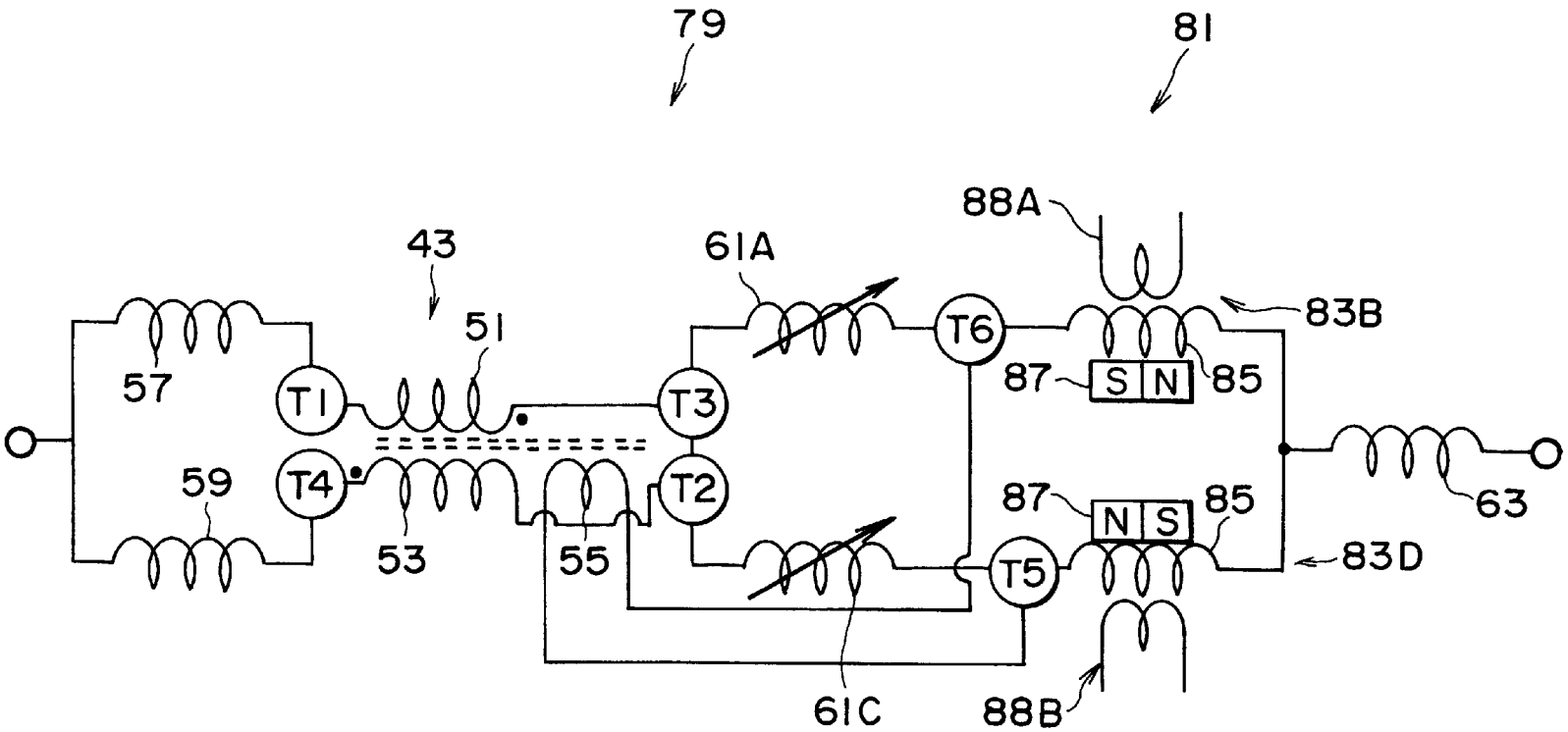
FIG. 11 is a connection diagram showing a second modification to the first embodiment of the deflection yoke according to the present invention.
Figures 12A, 12B, 12C:
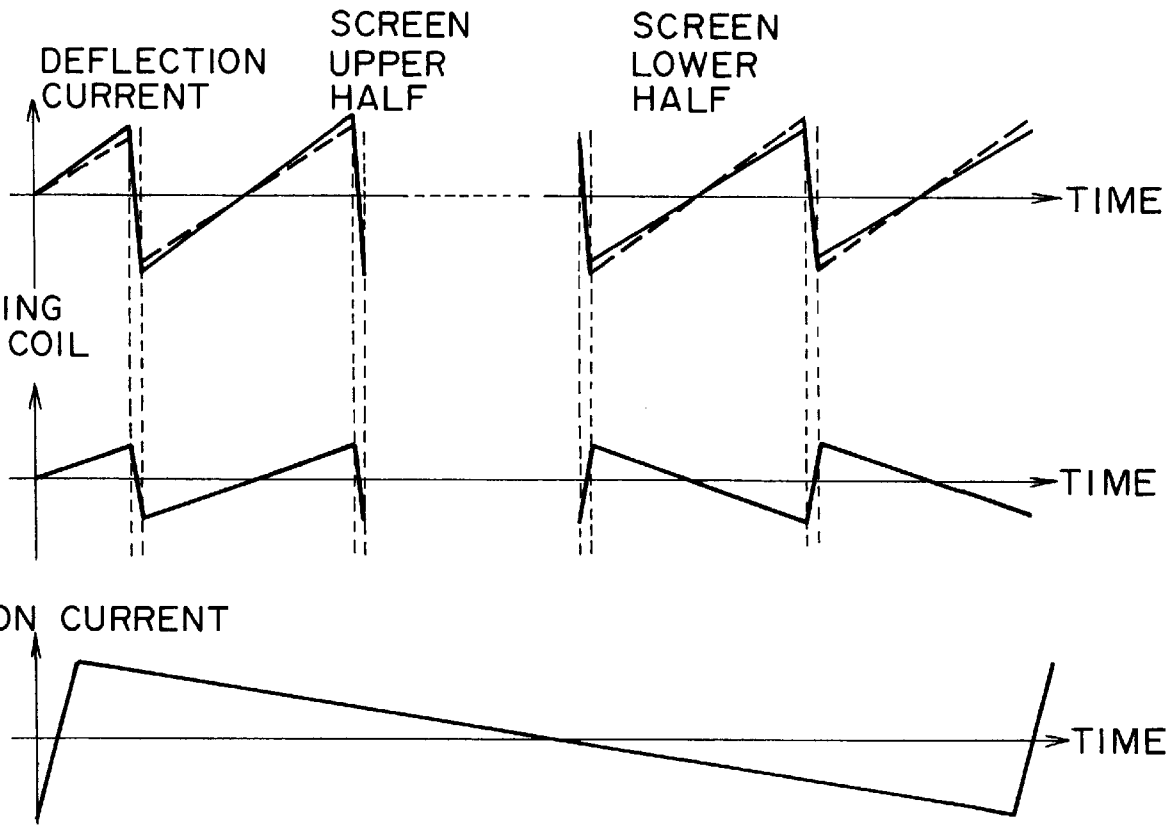
FIG. 12A is a waveform diagram showing deflection current flowing in the circuit of the second modification in the form of a current variation amount with respect to time.
FIG. 12B is a waveform diagram showing current flowing in a bias coil of the circuit of the second modification in the form of a current variation amount with respect to time.
FIG. 12C is a waveform diagram showing vertical deflection current with which bias magnetic fields are generated from coils of a bridge circuit of the circuit of the second modification in the form of a current variation amount with respect to time.
Figure 13:
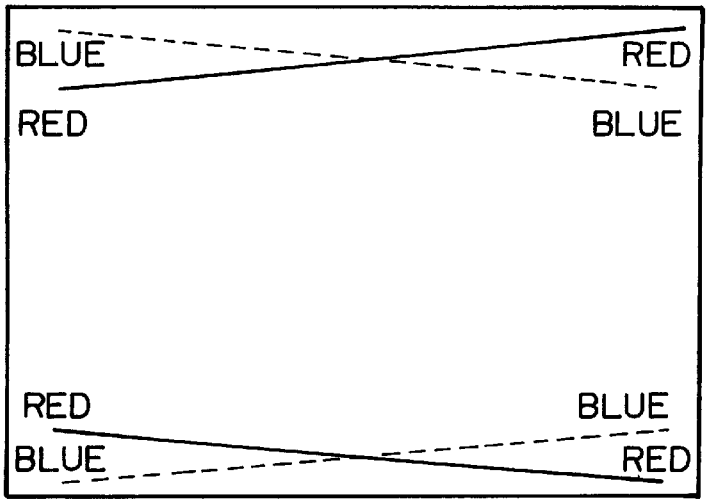
FIG. 13 is a diagrammatic view showing a PQV misconvergence pattern which appears on a screen of a cathode ray tube.

Referring now to FIGS. 11 to 13, there is shown a deflection yoke 79 according to the second modification to the first embodiment of the deflection yoke according to the present invention. With the deflection yoke 79 according to the modification 2, a bridge circuit 81 is used in place of the bridge circuit 61 described above. The bridge circuit 81 includes saturable reactors 83B and 83D in place of the variable inductors 61B and 61D (refer to FIG. 5) which are components of the bridge circuit 61. Each of the saturable reactors 83B and 83D includes an inductor 85 and a permanent magnet 87, and vertical deflection current is supplied to coils 88A and 88B to apply bias magnetic fields to the saturable reactors 83B and 83D. The construction of the remaining part of the deflection yoke 79 is similar to that of the deflection yoke 41 described above.

With the present deflection yoke 79, the inductance values of the saturable reactors 83*b* and 83*d* are modulated with vertical deflection current of a waveform shown in FIG. 12C. Consequently, the balance of the bridge circuit 81 varies in response to the magnitude and the direction of the vertical deflection current. Accordingly, current of a waveform shown in FIG. 12B can be supplied from the bridge circuit 81 to the bias coil 55 to correct the waveform of the deflection current to that shown in FIG. 12A. Consequently, correction of misconvergence called PQV illustrated in FIG. 13 is allowed.

Figure 14:
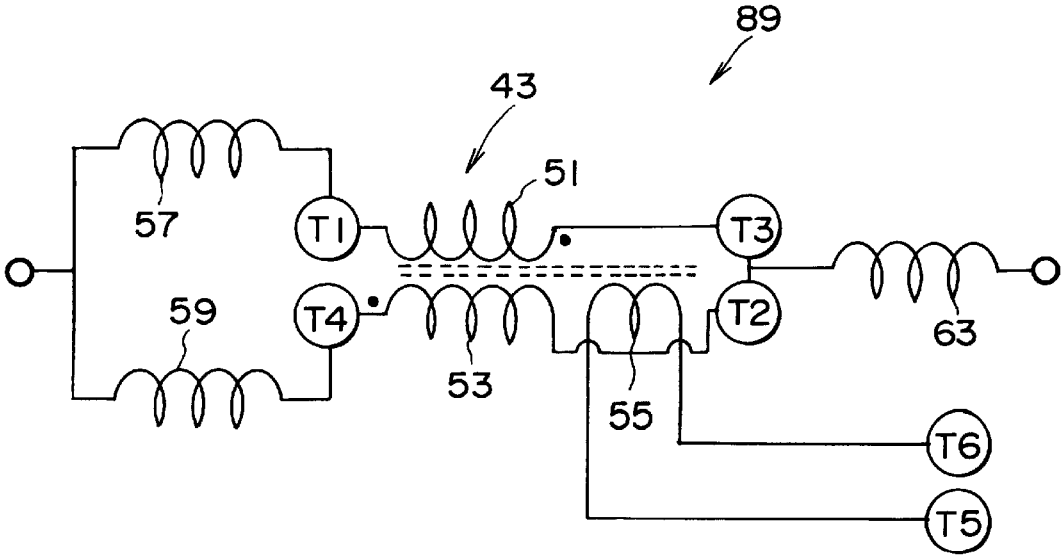
FIG. 14 is a connection diagram showing a second embodiment of the deflection yoke according to the present invention.

Now, a second embodiment of a deflection yoke according to the present invention is described with reference to FIG. 14. In the deflection yoke 89 according to the present second embodiment, the bridge circuit 61 shown in FIG. 5 is omitted, and the terminals T3 and T2 of the coils 51 and 53 are connected to each other, and a leakage magnetic field cancellation coil 63 is connected to the junction of the terminals T3 and T2. Further, a bias coil 55 is provided for the core 45 in a similar manner as described above. To the bias coil 55, current, for example, of a waveform similar to that shown in FIG. 9A described above or a waveform shown in FIG. 12B obtained by composing arbitrary currents which vary in periods of horizontal scanning and vertical scanning by means of a circuit inside a receiver for which a cathode ray tube is used. In short, by supplying current from the outside of the deflection yoke to the bias coil 55, arbitrary asymmetrical currents can be supplied to the upper side horizontal deflection coil 57 and the lower side horizontal deflection coil 59.

With the deflection yoke 89, magnetic fluxes can be generated inside the core 45 of the induction current suppression coil 43 with the composed current to vary the balance of the currents flowing through the upper side horizontal deflection coil 57 and the lower side horizontal deflection coil 59. As a result, the waveform can be adjusted freely in accordance with the characteristic of the cathode ray tube or the deflection yoke to perform misconvergence correction readily without using an expensive saturable reactor.

It is to be noted that, while it is described that the induction current suppression coils connected to the horizontal deflection coils of each of the deflection coils 41, 69, 79 and 89 described above is constructed such that a stranded wire is wound on a core of a ring shape, the coil is not limited to this and may include a C-shaped or E-shaped core. Further, where heat generation by eddy current does not matter, a solid wire may be used for the coil.

Further, it is described that one of two input terminals of each of the bridge circuits 61, 71 and 81 is connected to a leakage magnetic field cancellation coil. However, where a leakage magnetic field to the outside of a receiver does not matter, the cancellation coil may be omitted. In this instance, the input terminal is connected directly to a deflection circuit of the receiver.

As described in detail above, suppression of induction current induced from a raster rotation coil and correction of misconvergence performed by producing a difference in current between an upper side horizontal deflection coil and a lower side horizontal deflection coil can be achieved simultaneously.

Further, by supplying current to be supplied to a bias coil as current of an arbitrary waveform from the outside of the deflection yoke, a waveform can be adjusted freely to perform misconvergence correction readily without using an expensive saturable reactor.

While preferred embodiments of the present invention have been described using specific terms, such description is for illustrative purposes only, and it is to be understood that changes and variations may be made without departing from the spirit or scope of the following claims.

What is claimed is:

1. A deflection yoke, comprising:

a raster rotation coil;

a pair of horizontal deflection coils and a pair of vertical deflection coils;

a ring-shaped DY core which surrounds said horizontal and vertical deflection coils;

said pair of horizontal deflection coils being connected at one ends thereof to each other;

a pair of coils wound on a single core and connected in the opposite phases to each other to the other ends of said pair of horizontal deflection coils:

the other ends of said pair of coils which share said single core being connected to each other;

a biasing coil wound on said single core; and a bridge circuit composed of four inductors and having a pair of input terminals one of which is connected to the other ends of said pair of coils;

said bridge circuit having a pair of output terminals connected to said biasing coil.

2. A deflection yoke according to claim 1, wherein said four inductors which compose said bridge circuit are variable inductors.

3. A deflection yoke according to claim 1, wherein a pair of opposing ones of said four inductors which compose said bridge circuit are variable inductors while the remaining pair of inductors are inductors to each of which a bias magnetic field with a permanent magnet is applied.

4. A deflection yoke according to claim 1, wherein a pair of ones of said four inductors composing said bridge circuit which are directly connected to one of said pair of input terminals of said bridge circuit are variable inductors while the remaining pair of inductors are inductors to each of which a bias magnetic field with a permanent and another bias magnetic field which corresponds to vertical deflection current are applied.

5. A deflection yoke, comprising:

a raster rotation coil;

a pair of horizontal deflection coils and a pair of vertical deflection coils;

a ring-shaped core which surrounds said horizontal and vertical deflection coils:

said pair of horizontal deflection coils being connected at one ends thereof to each other;

a pair of coils wound on a single core and connected in the opposite phases to each other to the other ends of said pair of horizontal deflection coils: and the other ends of said pair of coils which share said single core being connected to each other;

a biasing coil wound on said single core;

said biasing coil being connected to a correction circuit provided in a receiver.

* * * * *